US005160426A

United States Patent [19]

Avidan

[11] Patent Number: 5,160,426

[45] **Date of Patent: * Nov. 3, 1992**

[54] PROCESS AND APPARATUS FOR INDIRECT HEATING OF CATALYST STRIPPER ABOVE A BUBBLING BED CATALYST REGENERATOR

[75] Inventor: Amos A. Avidan, Yardley, Pa.

[73] Assignee: Mobil Oil Corporation, Fairfax, Va.

[ * ] Notice: The portion of the term of this patent subsequent to Jul. 16, 2008 has been disclaimed.

[21] Appl. No.: 515,931

[22] Filed: Apr. 27, 1990

[51] Int. Cl.[5] ..... C10G 11/00; C10G 35/10; B01J 20/34

[52] U.S. Cl. ..... 208/113; 208/158; 208/159; 208/160; 208/164; 502/40; 502/43; 502/44

[58] Field of Search ..... 208/160, 153, 155, 159, 208/113, 164, 113

[56] References Cited

U.S. PATENT DOCUMENTS

| | | | |
|---|---|---|---|
| 3,392,110 | 7/1968 | Payne | 208/160 |
| 4,789,458 | 12/1988 | Haddad et al. | 208/151 |
| 4,820,404 | 4/1989 | Owen | 208/159 |
| 4,917,790 | 4/1980 | Owen | 208/160 |
| 5,032,251 | 7/1991 | Owen | 208/160 |
| 5,032,252 | 7/1991 | Owen et al. | 208/113 |

OTHER PUBLICATIONS

*Oil and Gas Journal*, "Fluid Catalytic Cracking Report", by Amos A. Avidan, Michael Edwards, and Hartley Owen (1990).

*Perry's Chemical Engineer's Handbook*, 6th Edition, pp. 11–48, Jul. 84.

*Primary Examiner*—Helane Myers

*Attorney, Agent, or Firm*—Alexander J. McKillop; Charles J. Speciale; Richard D. Stone

[57] ABSTRACT

A process and apparatus for achieving hot catalyst stripping of spent FCC catalyst in a stripper mounted over a bubbling bed regenerator. Hot catalyst stripping is achieved by indirect transfer of heat from the regenerator to the stripper. Heat pipes, surface modifications such as fins on the stripper vessel, or use of a stripper in, or connective with, a heat exchange tube bundle may be used to heat spent catalyst with heat from the regenerator dilute phase, without transferring catalyst from the regenerator. The benefits of hotter catalyst stripping are achieved, without increasing catalyst traffic in the regenerator.

6 Claims, 2 Drawing Sheets

PROCESS AND APPARATUS FOR INDIRECT HEATING OF CATALYST STRIPPER ABOVE A BUBBLING BED CATALYST REGENERATOR

BACKGROUND OF THE INVENTION

1. Field of the Invention

The invention relates to a process and apparatus for stripping and regenerating fluidized catalytic cracking catalyst.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425 C.-600 C., usually 460 C.-560 C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500 C.-900 C., usually 600 C.-750 C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Although reactor residence time has continued to decrease, the height of the reactors has not. Although the overall size and height of much of the hardware associated with the FCC unit has decreased, the use of all riser reactors has resulted in catalyst and cracked product being discharged from the riser reactor at a fairly high elevation. This elevation makes it easy for a designer to transport spent catalyst from the riser outlet, to a catalyst stripper at a lower elevation, to a regenerator at a still lower elevation.

The need for a somewhat vertical design, to accommodate the great height of the riser reactor, and the need to have a unit which is compact, efficient, and has a small "footprint", has caused considerable evolution in the design of FCC units, which evolution is reported to a limited extent in the Jan. 8, 1990 Oil & Gas Journal article. One modern, compact FCC design is the Kellogg Ultra Orthoflow converter, Model F, which is shown in FIG. 1 of this patent application, and also shown as FIG. 17 of the Jan. 8, 1990 Oil & Gas Journal article discussed above. The compact nature of the design, and the use of a catalyst stripper which is contiguous with and supported by the catalyst regenerator, makes it difficult to expand or modify such units. The catalyst stripper design is basically a good one, which achieves some efficiencies because of its location directly over the bubbling bed regenerator. The stripper can be generously sized, does not have to fit around the riser reactor as in many other units, and the stripper is warmed slightly by its close proximity to the regenerator, which will improve its efficiency slightly.

Although such a unit works well in practice, the stripping of spent catalyst is never as complete as desired by the refiner. In addition, FCC units are being pushed to accept poorer feeds, particularly feeds containing large amounts of resid. These growing demands placed on FCC units exacerbated four existing problem areas in the regenerator, namely problems with sulfur, steam, temperature and NOx. These problems will each be reviewed in more detail below.

SULFUR

Much of the sulfur in the feed ends up as SOx in the regenerator flue gas. Higher sulfur levels in the feed, combined with a more complete regeneration of the catalyst in the regenerator increases the amount of SOx in the regenerator flue gas. Some attempts have been made to minimize the amount of SOx discharged to the atmosphere through the flue gas by including catalyst additives or agents to react with the SOx in the flue gas, and by including a catalyst, such as Pt, which promotes the oxidation of $SO_2$ to $SO_3$, which is more rapidly adsorbed on the additive. These agents pass with the regenerated catalyst back to the FCC reactor where the reducing atmosphere releases the sulfur compounds as H2S. Suitable agents for $SO_x$ adsorption are described in U.S. Pat. Nos. 4,071,436 and 3,834,031. Use of cerium oxide agent for this purpose is shown in U.S. Pat. No. 4,001,375.

Unfortunately, the conditions in most FCC regenerators are not the best for SOx adsorption. The high temperatures in modern FCC regenerators (up to 870 C. (1600 F.)) impair SOx adsorption. One way to minimize SOx in flue gas is to pass catalyst from the FCC reactor to a long residence time steam stripper, as disclosed in U.S. Pat. No. 4,481,103 to Krambeck et al which is incorporated by reference. This process preferably steam strips spent catalyst at 500-550C. (932 to 1022 F.), which is beneficial but not sufficient to remove some undesirable sulfur- or hydrogen-containing components.

STEAM

Steam is always present in FCC regenerators although it is known to cause catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

Steaming of catalyst becomes more of a problem as regenerators get hotter. Higher temperatures greatly accelerate the deactivating effects of steam.

TEMPERATURE

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. There is speculation that in the regenerator, the burning of coke and unstripped hydrocarbons may lead to higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to CO2. However, in some cases, this control is insufficient, and also leads to increased CO emissions, which can be a problem unless a CO boiler is present.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. The Kellogg H.O.C. regenerator has a catalyst cooler connected to the dense bed of the regenerator. These approaches remove heat from the regenerator, but will not prevent poorly, or even well, stripped catalyst from experiencing very high surface or localized temperatures in the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,156 to Jahnig et al; 2,492,948 to Berger; and 2,506,123 to Watson.

NOX

Burning of nitrogenous compounds in FCC regenerators has long led to creation of minor amounts of NOx, some of which were emitted with the regenerator flue gas. Usually these emissions were not much of a problem because of relatively low temperature, a relatively reducing atmosphere from partial combustion of CO and the absence of catalytic metals like Pt in the regenerator which increase NOx production.

Many FCC units now operate at higher temperatures, with a more oxidizing atmosphere, and use CO combustion promoters such as Pt. These changes in regenerator operation reduce CO emissions, but usually increase nitrogen oxides (NOx) in the regenerator flue gas. It is difficult in a catalyst regenerator to completely burn coke and CO in the regenerator without increasing the NOx content of the regenerator flue gas, so NOx emissions are now frequently a problem. These problems are more severe in bubbling bed regenerators, because of relatively poor catalyst circulation (large stagnant regions in the dense bed) and the presence of large bubbles of regeneration gas which leads to localized high concentrations of oxygen, which increases NOx emissions.

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to CO2, while minimizing the formation of NOx.

U.S. Pat. No. 4,199,435 suggests steam treating conventional metallic CO combustion promoter to decrease NOx formation without impairing too much the CO combustion activity of the promoter.

Process modifications are suggested in U.S. Pat. No. 4,413,573 and U.S. Pat. No. 4,325,833 directed to two- and three-stage FCC regenerators, which reduce NOx emissions.

U.S. Pat. No. 4,313,848 teaches countercurrent regeneration of spent FCC catalyst, without backmixing, to minimize NOx emissions.

While such process modifications may be useful for new construction they can not be easily added to existing units, especially not to compact regenerator/stripper designs such as the Kellogg H.O.C. regenerator.

U.S. Pat. No. 4,309,309 teaches the addition of a vaporizable fuel to the upper portion of a FCC regenerator to minimize NOx emissions. Oxides of nitrogen formed in the lower portion of the regenerator are reduced in the reducing atmosphere generated by burning fuel in the upper portion of the regenerator.

U.S. Pat. No. 4,235,704 suggests that too much CO combustion promoter causes NOx formation, and calls for monitoring the NOx content of the flue gases, and adjusting the concentration of CO combustion flue gas.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above, directed to reducing NOx emissions, from U.S. Pat. No. 4,300,997 to U.S. Pat. No. 4,542,114, are incorporated herein by reference.

The reduction in NOx emissions achieved by the above approaches helps some but still may fail to meet the ever more stringent NOx emissions limits set by local governing bodies. Much of the NOx formed is not the result of combustion of N2 within the FCC regenerator, but rather combustion of nitrogen-containing compounds in the coke entering the FCC regenerator.

Unfortunately, the trend to heavier feeds usually means that the amount of nitrogen compounds on the coke will increase so NOx emissions will increase. Higher regenerator temperatures also tend to increase NOx emissions. It would be beneficial, in existing refineries, to have a way to reduce NOx emissions so that heavier feeds, and environmental concerns, can be accommodated.

I realized that a better catalyst stripper design was needed. A better stripper would attack most of the problems in the regenerator at their source, namely poor stripping. Better stripping would permit increased recovery of valuable, strippable hydrocarbons and remove more hydrogen from spent catalyst to minimize hydrothermal degradation in the regenerator. It would also remove more sulfur-containing compounds from spent catalyst prior to regeneration to minimize SOx in the regenerator flue gas and would help reduce regenerator temperature by reducing the amount of material burned in it. Hotter stripping may even permit the gasification of some of the carbonaceous material on the catalyst to synthesis gas or to hydrocarbons, either of which would be better than coke. The problems were obvious, but a solution to these problems, which could be incorporated into existing FCC regenerators, especially compact designs, was not.

I reviewed the work that others had done on improving stripping, and found nothing directly applicable to the special problems of better stripping in FCC units where the stripper was so closely associated with, and supported by, a bubbling dense bed regenerator. I wanted the benefits of hot stripping, but without the increased catalyst traffic associated with achieving hot stripping by recycle of hot regenerated catalyst into the stripping section. I also wanted to avoid the formidable mechanical problems associated with recycling hot regenerated catalyst from a bubbling dense bed regenerator up into a stripper which was at an elevation 10 to 20 meters above the regenerator, and practically embedded in the regenerator.

I discovered a way to achieve high temperature stripping of coked FCC catalyst which could be readily retrofitted into strippers operating above and supported by bubbling dense bed regenerators. By using conventional, proven equipment in an unconventional way, I was able to transfer heat from the regenerator to the stripper, without transferring hot catalyst, or increasing catalyst traffic. Indirect heat exchange provided a way to improve stripping, increase the yield of valuable liquid product, reduce the load placed on the catalyst regenerator, minimize SOx and NOx emissions and permit the unit to process more difficult feeds. Regenerator temperatures can be reduced somewhat, and the hydrothermal deactivation of catalyst in the regenerator reduced.

BRIEF SUMMARY OF THE INVENTION

Accordingly, the present invention provides a fluidized catalytic cracking process wherein a heavy hydrocarbon feed comprising hydrocarbons having a boiling point above about 650 F is catalytically cracked to lighter products comprising the steps of: catalytically cracking said feed in a catalytic cracking zone operating at catalytic cracking conditions by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst; separating cracked products from spent catalyst in said catalyst disengaging zone to produce a cracked product vapor phase which is recovered as a product and a spent catalyst phase which is discharged from said disengaging zone into a catalyst stripper in a stripper vessel contiguous with and beneath said disengaging zone; steam stripping said spent catalyst with stripping steam in said stripping zone to produce a stripper vapor comprising cracked products and stripping steam which is removed from said stripping zone as a product and a stripped catalyst phase comprising stripped catalyst having a temperature which is discharged into a vertical stripper standpipe beneath said stripping zone; discharging stripped catalyst from said stripper standpipe into a catalyst regeneration zone contiguous with and beneath said stripping zone; regenerating said stripped catalyst in a regeneration zone, operating at catalyst regeneration conditions, comprising a single dense phase bubbling fluidized bed of catalyst to which an oxygen containing regeneration gas is added and from which hot regenerated catalyst, having a regenerated catalyst temperature above said stripped catalyst temperature, is withdrawn and recycled to said riser reactor, characterized by heating said stripped catalyst from said steam catalyst stripper by indirect contact heat exchange with hot regenerated catalyst from said bubbling dense bed in a heat exchange means connective with said stripper to produce heated stripped catalyst having a higher temperature than said stripped catalyst temperature.

In another embodiment, the present invention provides an apparatus for the fluidized catalytic cracking of a heavy feed to lighter more valuable products comprising: a riser reactor cracking means having a base portion connective with a source of heavy feed and connective with a bubbling dense phase fluidized bed of regenerated catalyst within a catalyst regeneration means; a riser outlet at the top of the riser reactor connective with a catalyst disengaging means adapted to separate a cracked product vapor stream from a spent catalyst stream, and discharge said spent catalyst into a catalyst stripper means; a catalyst stripping means, located above and supported by said catalyst regeneration means, said stripping means adapted to receive spent catalyst from said disengaging means and contact said spent catalyst with a stripping gas to produce a stripper effluent vapor stream and a stripped catalyst stream which is discharged down into a primary stripper catalyst standpipe; and comprising means for indirect transfer of heat from said regenerator into said stripper and produce heated, stripped catalyst; a catalyst regeneration means adapted to receive heated stripped catalyst discharged from said stripping means and to regenerate said stripped catalyst as a bubbling dense phase fluidized bed by contact with a source of regeneration gas and produce a regenerated catalyst stream and a dilute phase flue gas stream comprising entrained catalyst.

DESCRIPTION OF PREFERRED EMBODIMENTS

Figure 1:
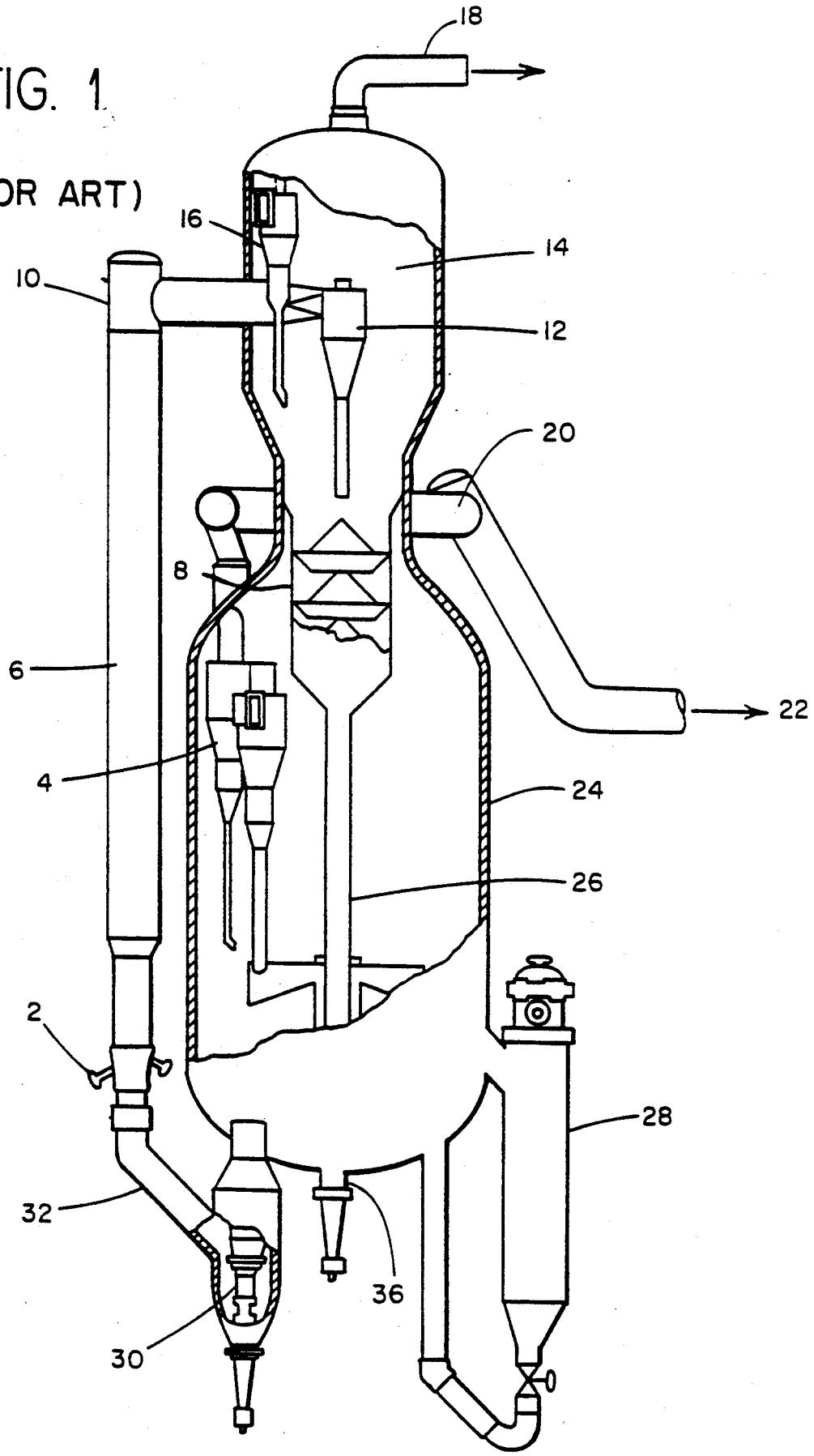
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed.

Figure 2:
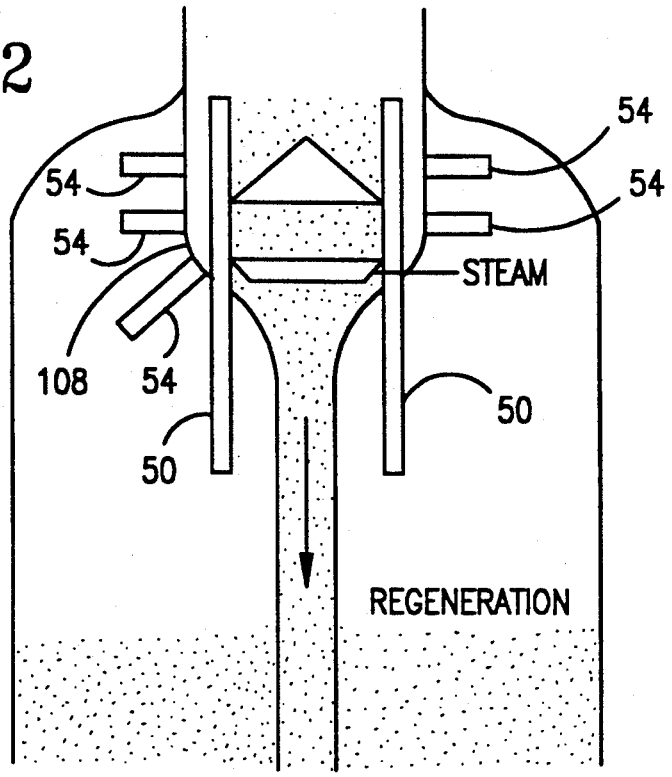
FIG. 2 (invention) is a schematic view of a preferred embodiment of the invention, showing indirect heat exchange of the stripper, using heat pipes and/or fins.

In FIG. 2 (invention) only the changes made to the old unit are shown, and many essential and/or conventional details, such as the riser reactor and catalyst cooler have been omitted. Like elements in FIG. 1 and 2 have like numerals.

This embodiment is especially preferred when it is desired to achieve the benefits of hot stripping of catalyst, with minimal changes to the bubbling bed regenerator.

A hot stripper 108 is created by merely adding heat to the catalyst flowing through the existing stripper. In the embodiment shown, two methods of heat transfer are shown, but the method of getting heat into the stripper is not as important as the amount of heat that is added. The most effective method of adding heat will be the use of heat pipes 50. A less costly, but less effective method of heat transfer is use of fins 54 outside of the hot stripper, and/or fins 52 inside the hot stripper. Other conventional methods of enhancing indirect heat transfer can also be used, but not necessarily with equivalent results, i.e., dimples, ridges, use of conductive refractories can all be used to enhance heat transfer into the stripper.

It is possible, and beneficial, to lengthen the stripper somewhat, provide additional stripping stages, i.e., multiple levels of stripping steam addition, and multiple levels of stripper effluent vapor removal, but such modifications are costly, and frequently will not be needed because of the improved operation of conventional strippers due to hotter operation.

Figure 3:
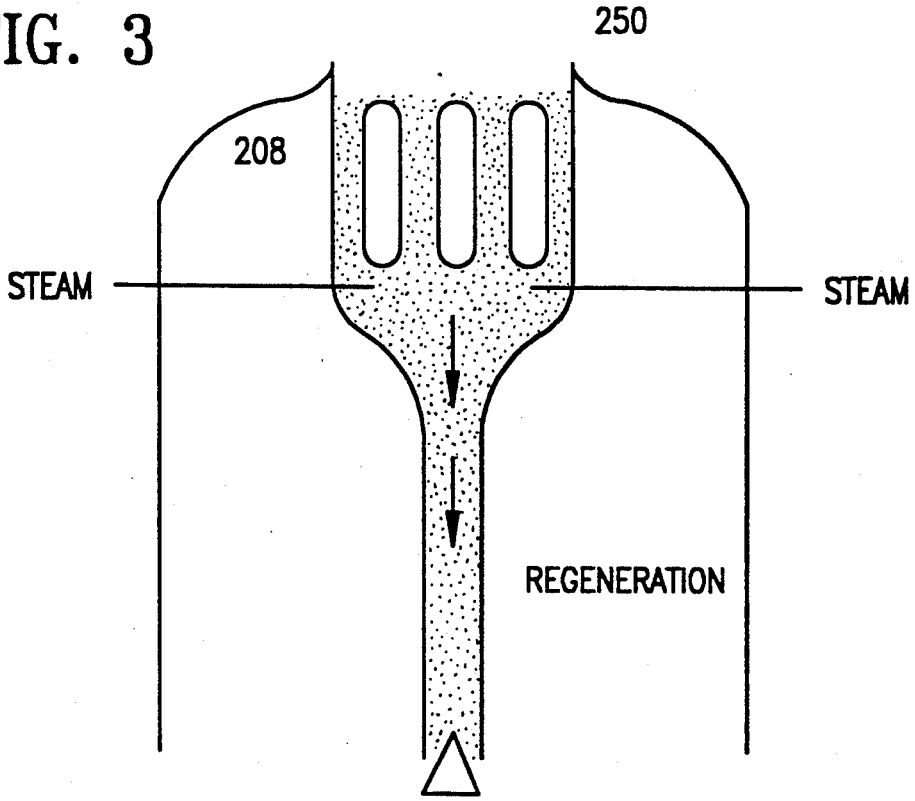
FIG. 3 (invention) is a schematic view of another preferred embodiment of the invention, showing hot stripping in a tube type heat exchanger.

In FIG. 3, maximum indirect heat exchange is obtained by using as a stripper a tube bundle similar to that used in tube type heat exchangers. The spent catalyst passes through the shell side of the heat exchanger, while the tube side is open to the dilute phase region of the regenerator vessel 24.

It is also possible to put the spent catalyst in the tubes, and allow the shell 24 of the regenerator to be the "shell" of the heat exchanger. When the spent catalyst is passed through the tubes, it usually will be beneficial to provide at least one region in the hot stripper where stripper effluent vapor may be withdrawn, without having to migrate up through a long thin tube.

Use of the FIG. 3 embodiment will require major modifications to the unit, but will allow the stripping temperature to approach that of the dilute phase of the regenerator, with an approach to within 100 F. being easily achieved, and approach to within 50 F. or less being possible without use of an inordinately large heat exchanger surface area. This embodiment will be most attractive when used as an add-on to existing stripping equipment, i.e., with continued use of the conventional stripper, perhaps with somewhat reduced steam use, with the tube bundle stripper of the invention used for a vigorous second stage of stripping.

DESCRIPTION OF PREFERRED EMBODIMENTS

FCC FEED

Any conventional FCC feed can be used. The process of the present invention is especially useful for processing difficult charge stocks, those with high levels of CCR material, exceeding 0.5 and up to 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is very useful with heavy feeds having, and with those having a metals contamination problem. With these feeds, the possibility of reduced burning load in the regenerator, and even more importantly, the possibility of a dryer regenerator, because of reduced hydrogen content of coke, will be a significant benefit.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–50 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Katalistiks International, Inc.'s "DeSox."

CO combustion additives are available from most FCC catalyst vendors.

The FCC catalyst composition, per se, forms no part of the present invention.

CRACKING REACTOR/REGENERATOR

The FCC reactor and regenerator shell 24, per se, are conventional, and are available from the M. W. Kellogg Company.

The modifications needed to add the hardware required to enhance indirect heat exchange into the hot stripper are well within the skill of the art.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900 to about 1050 F.

INDIRECT HEAT TRANSFER MEANS

The process of the present invention requires that at least one means be provided to transfer heat into the stripper from the regenerator. Roughly three categories of heat transfer means can be considered, although there is or can be considerable overlap between categories. The three categories are heat pipes, surface modifications, and tube bundles.

Heat pipes are a mechanical apparatus well known in the heat transfer arts. They comprise an outer sealed cylindrical conduit which sealed to retain a small amount of working fluid which may be vaporized and condensed at the temperatures of the heat source and heat sink, respectively. The working fluid is vaporized in the catalyst regenerator and condensed in the catalyst stripper. A wick is provided to transfer the condensed fluid from the stripper back to the regenerator.

Heat pipes work best when vertical, which means they are especially well suited for use in heating a catalyst stripper mounted above a catalyst regenerator.

Heat pipes have heretofore been proposed for use in removing heat from FCC regenerators, by transferring the heat to boil water and make steam, and heat pipes of similar design may be used herein. The heat pipes should be made of metals which can withstand the harsh erosive environment within FCC regenerators and strippers, so use of heavy gage materials, such as thick stainless steel for the pipes is preferred. Standard references describe working fluids which are suitable, and conventional high temperature working fluids such as sodium, potassium, cesium or mercury can be considered for use herein. Because of the possibility of a tube rupture, a working fluid should be selected which will do the least amount of damage to the FCC catalyst inventory. Sodium is a poison of sorts for FCC catalyst, but a well known one, which can be tolerated in relatively large amounts, so this may be a preferred working fluid.

For reasons of ease of fabrication and installation, and erosion resistance, it will usually be preferred to operate with heat pipes having on outer diameter of one to five inches, and a length of 10 to 30 feet. The heat pipes may be used in bundles or clumps or evenly distributed about the hot stripper. Radial distribution of the heat pipes can frequently be accommodated in existing strippers, without too much disruption of catalyst flow. Means may be provided for additional stripping steam addition, to aid in stripping, catalyst flow past the heat pipes, or to increase the heat transfer coefficient on the spent catalyst side of the heat pipe.

More details on the use of heat pipes to remove heat from FCC regenerators are disclosed in U.S. Pat. No. 4,595,567, which is incorporated herein by reference.

SURFACE MODIFICATIONS

Surface modification which may be made to the shell of the existing strippers include such things as fins, dimples, ridges and the like. In general, vertical fins will be least disruptive to catalyst flow within the stripper. Some effective "surface modification" can be quite simples, such as use of relatively large angle irons on the inside and outside shell of the existing stripper. The shell can still be lined with refractory (for erosion resistance) preferably with just the minimal amount need, leaving one to four inches or so of angle iron sticking out of the refractory. Use of surfaces normal to catalyst flow inside the stripper will increase stirring and heat transfer, but cause greater disruption to flow and be subject to rapid erosion.

TUBE BUNDLES

Tube bundles provide the most effective indirect heat transfer, because they allow intimate contact of relatively cold spent catalyst with the hot, dilute phase region of the regenerator. Tube bundles are also the most costly, and hardest to add to existing regenerators. Tube bundles generate orders of magnitude more surface area than is available around the shell of existing strippers, so greatly enhanced heat transfer rates are possible. Tube bundles have been used for years to remove heat from FCC regenerators, in fact in the 40's most FCC regenerators required external catalyst coolers.

The spent catalyst may flow through the tubes or the shell. Spent catalyst flow may be actively controlled by addition of steam to aerate the catalyst and reduce the apparent viscosity of the flowing catalyst. When relatively large tubes are used, or when the spent catalyst is in the shell, it will be possible to remove stripper effluent vapor from the top of the hot stripper. Usually it will be preferred to provide at least one stripper effluent vapor removal line downstream of the tube bundle.

It is also possible to use a tube bundle catalyst heater which achieves very little stripping, and whose primary purpose is indirect heat exchange of spent catalyst, so that it may be refluxed to the stripper. This design increases the solids traffic in the stripper without increasing the solids traffic in the regenerator. Use of a tube bundle to heat spent catalyst, and return it to the stripper, facilitates very close control of the amount of heating achieved, by controlling the amount of aeration gas used to fluidize spent catalyst in the shell, and lift gas to control the gross flow of spent catalyst through the shell. Such use of heat exchangers as catalyst coolers is well known, and shown in FIG. 33 of Fluid Catalytic Cracking Report, Avidan et al, previously cited.

HOT STRIPPER CONDITIONS

Conventional hot stripping operating conditions may be used. Typical hot stripper operating conditions include temperatures which are at least 20 F. above the temperature in the conventional stripping zone, preferably at least 50 F. above the temperature in the conventional stripper, and most preferably temperatures in the hot stripper are at least 100 F. or more hotter. The hot stripping may be one stage, or multi-stage.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

DISCUSSION OF HOT STRIPPING BENEFITS

The present invention strips catalyst at a temperature higher than the riser exit temperature to separate hydrogen, as molecular hydrogen or hydrocarbons from the coke which adheres to catalyst. This minimizes catalyst steaming, or hydrothermal degradation, which typically occurs when hydrogen reacts with oxygen in the FCC regenerator to form water. The high temperature stripper (hot stripper) also removes much of the sulfur from coked catalyst as hydrogen sulfide and mercaptans, which are easy to scrub. In contrast, burning from coked catalyst in a regenerator produces SOx in the regenerator flue gas. The high temperature stripping recovers additional valuable hydrocarbon products to prevent burning these hydrocarbons in the regenerator.

The present invention, by imposing an increasing temperature profile on the spent catalyst, minimizes the time spent catalyst is stripped at temperatures above 1000 F. This will minimize somewhat deactivation of the catalyst due to steam contact at high temperature.

I claim:

1. A fluidized catalytic cracing process wherein a heavy hydrocarbon feed comprising hydrocarbons having a boiling point above about 650 F is catalytically cracked to lighter products comprising the steps of:

catalytically cracking said feed in a catalytic cracking zone operating at catalytic cracking conditions by mixing, in the hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst;

separating cracked prodcuts from spent catalyst in said catalyst disengaging zone to produce a cracked product vapor phase which is recovered as a product and a spent catalyst phase which is discharged from said disengaging zone into a heated catalyst stripper in a stripper vessel contiguous with and beneath said disengaging zone and above a bubbling dense bed catalyst regenerator;

heating catalyst in said stripper, by indirect heat exchange with hot regenerated catalyst in said bubbling dense bed regenerator using a heat exchange means selected from the group of heat pipes, tube bundles and surface mounted modifications to the walls of said stripper vessel to increase heat transfer, and steam stripping said spent catalyst with stripping steam in said stripping vessel to prodcut a stripper vapor comprising cracked products and stripping steam which is removed from said stripped zone as a product and a hot stripped catalyst phase which is discharged into a vertical stripper standpipe beneath said stripping zone;

discharging said hot stripped catalyst from said stripper standpipe into the bubbling dense phase fulidized bed catalyst regeneration zone contiguous with and beneath said stripping zone;

regenerating said hot stripped catalyst in said regeneration zone at catalyst regeneration conditions, by contact with an oxygen containing regeneration gas to produce hot regenerated catalyst having a temperature above said hot stripped catalyst temeprature and indirectly heating said hot stripping vessel; and recycling hot regenerated catalyst to said riser reactor.

2. The process of claim 1 wherein the indirect heat exchange means comprises a plurality of heat pipes having upper and lower ends, said upper ends extending up into at least a portion of said stripper and said lower ends extending down into at least a portion of the dilute phase region above said bubbling dense bed in said regenerator.

3. The process of claim 1 wherein the indirect heat exchange means comprises surface mounted conductive heat transfer means for enhancing heat transfer from the dilute phase region above the bubbling dense bed regenerator to the spent catalyst through a wall of the stripper vessel, said means being mounted on a surface of an inner or an outer wall of said stripper vessel.

4. The process of claim 3 wherein said surface mounted means comprises vertical fins.

5. The process of claim 1 wherein said heat exchange means comprises a tube bundle, with said spent catalyst passing through the tubes of said bundle and wherein the shell side of said bundle is open to the dilute phase region above said regenerator bubbling dense bed.

6. The process of claim 1 wherein said heat exchange means comprises a tube bundle in a shell, with said spent catalyst passing through shell side, and the tube side of said bundle is open to the dilute phase region above said regenerator bubbling dense bed.

* * * * *

UNITED STATES PATENT AND TRADEMARK OFFICE

CERTIFICATE OF CORRECTION

PATENT NO. : 5,160,426

DATED : November 3, 1992

INVENTOR(S) : A. A. Avidan

It is certified that error appears in the above-identified patent and that said Letters Patent is hereby corrected as shown below:

Column 11, line 42, "cracing" should be --cracking--

Column 11, line 48, after "the" and before "hot" insert --base of a riser reactor, a heavy crackable feed with a source of--

Column 12, line 12, "prodcut" should be --produce--

Column 12, line 15, "stripped" should be --stripping--

Column 12, lines 19 and 20, "fulidized" should be --fluidized--

Signed and Sealed this

Nineteenth Day of October, 1993

*Attest:*

Bruce Lehman

BRUCE LEHMAN

*Attesting Officer*

*Commissioner of Patents and Trademarks*